US008272853B2

(12) United States Patent
Ko

(10) Patent No.: US 8,272,853 B2
(45) Date of Patent: Sep. 25, 2012

(54) ARRANGEMENT FOR A QUICK POSITIONING OF A MOTOR OF A CROSS-FLOW FAN

(76) Inventor: Chen-Hui Ko, Taoyuan Hsien (TW)

( * ) Notice: Subject to any disclaimer, the term of this patent is extended or adjusted under 35 U.S.C. 154(b) by 646 days.

(21) Appl. No.: 12/461,351

(22) Filed: Aug. 10, 2009

(65) Prior Publication Data

US 2011/0033325 A1 Feb. 10, 2011

(51) Int. Cl.
*F04B 35/04* (2006.01)
*F04B 17/00* (2006.01)
*F04B 35/00* (2006.01)

(52) U.S. Cl. ..... 417/423.15; 417/360; 417/423.14; 415/53.1

(58) Field of Classification Search ..... 417/234, 417/360, 363, 423.7, 423.14, 423.15; 415/53.1
See application file for complete search history.

(56) References Cited

U.S. PATENT DOCUMENTS

| | | | | |
|---|---|---|---|---|
| 3,306,526 | A * | 2/1967 | Laing | 415/53.3 |
| 4,754,697 | A * | 7/1988 | Asselbergs | 417/360 |
| 5,060,720 | A * | 10/1991 | Wollaber et al. | 417/371 |
| 7,566,262 | B2 * | 7/2009 | Hu | 454/329 |
| 8,007,225 | B2 * | 8/2011 | Ko | 415/53.1 |
| 8,177,485 | B2 * | 5/2012 | Ko | 415/53.1 |
| 2005/0140233 | A1 * | 6/2005 | Kojima et al. | 417/423.7 |
| 2006/0233638 | A1 * | 10/2006 | Chen | 415/53.1 |

* cited by examiner

*Primary Examiner* — Peter J Bertheaud
(74) *Attorney, Agent, or Firm* — Rosenberg, Klein & Lee

(57) ABSTRACT

An arrangement for a quick positioning of a motor of a cross-flow fan including a housing, a cross-flow fan, and an automatically adjustable motor apparatus. The motor apparatus consists of a motor body and a mounting base for the motor body. The mounting base of the motor apparatus is integrally formed with the motor body. Alternatively, the motor body and the mounting base are separately formed and then combined together. The mounting base includes a mounting member and a flange member for a rapid alignment and attachment to the mounting hole and the convex ring such that the motor may be secured from outside in place. Accordingly, a convenient assembly is achieved. Moreover, the trembling motion or the noise created during the operation will be lessened for enhancing the quality and the reliability of the cross-flow fan.

6 Claims, 9 Drawing Sheets

ARRANGEMENT FOR A QUICK POSITIONING OF A MOTOR OF A CROSS-FLOW FAN

BACKGROUND OF THE INVENTION

1. Field of the Invention

The invention relates to a cross-flow fan for a control panel of a gymnastic apparatus, and more particularly, to an arrangement that permits a rapid securing action from outside and an accurate alignment.

2. Description of the Related Art

People are often covered with sweat in performing exercise on a gymnastic apparatus. It must be very pleasant when a wind slowly blows through the face. As shown in FIG. 1, a fan is fitted to the control panel 21 of a conventional treadmill 20 for providing a current of air blowing over to the operator.

As shown in FIGS. 2 and 3, a conventional cross-flow fan apparatus consists of a housing 11, a motor 12 and a cross-flow fan 13. The cross-flow fan 13 is made by riveting a plurality of metal pieces and metal posts. Over ten metal vanes 131 fit into fixing slots of left and right metal plates 132. A shaft sleeve 133 coupled to a rotary shaft 121 is riveted at the center of the left metal plate 132. A central shaft 135 is riveted to the center of the right metal plate 134. A bushing 14 slips over the central shaft 135 and is then mounted on the housing 11 by a shaft-positioning seat 15 in place.

When the above-mentioned cross-flow fan apparatus 10 is driven by the motor 12 in lateral (X-X) rotation, the cross-flow fan 13 will have a problematic rotation and cause an undesirable deformation as a result of misalignment of the rotary shaft 121 of the motor to the shaft sleeve 133 of the cross-flow fan 13. Thus, the-motor 12 is easily broken down. Accordingly, it is very important if the center of the motor 12 is properly aligned.

According to the conventional way for installing the motor 12, screws 122 are tightened outwards in the positioning holes at the internal side of the housing 11 for fixing the motor 12 in place at the external side of the housing 11 after the rotary shaft 121 of the motor 12 extends into the housing 11. However, the above-mentioned way causes a difficult assembly since only a very small internal room is available within the housing 1, thereby requiring much assembly time and causing an insufficient accuracy. Moreover, the defective fraction of the products is increased. This is one of the drawbacks.

Moreover, a trembling motion takes place when the conventional cross-flow fan 13 is operated at a high speed. This will do harm to the electronic elements within the control panel 21. As a result, the anti-vibration design must be taken into account as well.

SUMMARY OF THE INVENTION

An object of the invention is to provide an arrangement for a quick positioning of a motor of a cross-flow fan in which a mounting base is pre-mounted at the mounting surface of the motor body such that the motor can be rapidly and accurately mounted from outside in the shaft hole of the cross-flow fan. Accordingly, a convenient assembly and an automatic correction are achieved.

Another object of the invention is to provide a cross-flow fan in which a shock-absorbing body is interposed between a driving shaft 51 of the motor and the shaft hole of the cross-flow fan so that the trembling motion is considerably lessened for reducing the noise. Thus, ii is especially applicable to the gymnastic apparatus.

In order to achieve the above-mentioned object, an arrangement for a quick positioning of a motor of a cross-flow fan in accordance with the invention includes:

a) a housing having a left plate, a right plate and an L-shaped wind deflector between the left and right plates, the left plate having a first mounting hole, the right plate having a second mounting hole with a greater diameter, a convex ring and several securing lugs being arranged around the external rim of the second mounting hole;

b) a cross-flow fan having a shaft at the left side thereof and positioned within the first mounting hole, a third mounting hole being axially formed at the right side of the cross-flow fan for accommodating a shock-absorbing body, the shock-absorbing body being provided with a shaft-retaining hole in the axial direction; and c) a motor apparatus having a motor body and a mounting base, the mounting base being disposed at the side facing a driving shaft of the motor body, the mounting base having a mounting member and a flange member, the mounting member being matched to the convex ring for a tight insertion into the second mounting hole, the flange member being formed around the rim of the mounting member and snugly secured to the convex ring, the external side of the flange member being provided with projecting ears corresponding to the securing lugs of the convex ring, the projecting ears being secured by screws from outside such that the motor apparatus may rapidly and precisely fit into the second mounting hole, the driving shaft being extended into the shaft-retaining hole of the shock-absorbing body of the cross-flow fan for imparting the rotary motion to the cross-flow fan.

BRIEF DESCRIPTION OF THE DRAWINGS

The accomplishment of this and other objects of the invention will become apparent from the following descriptions and its accompanying figures of which.

DETAILED DESCRIPTION OF THE PREFERRED EMBODIMENT

Figure 1:
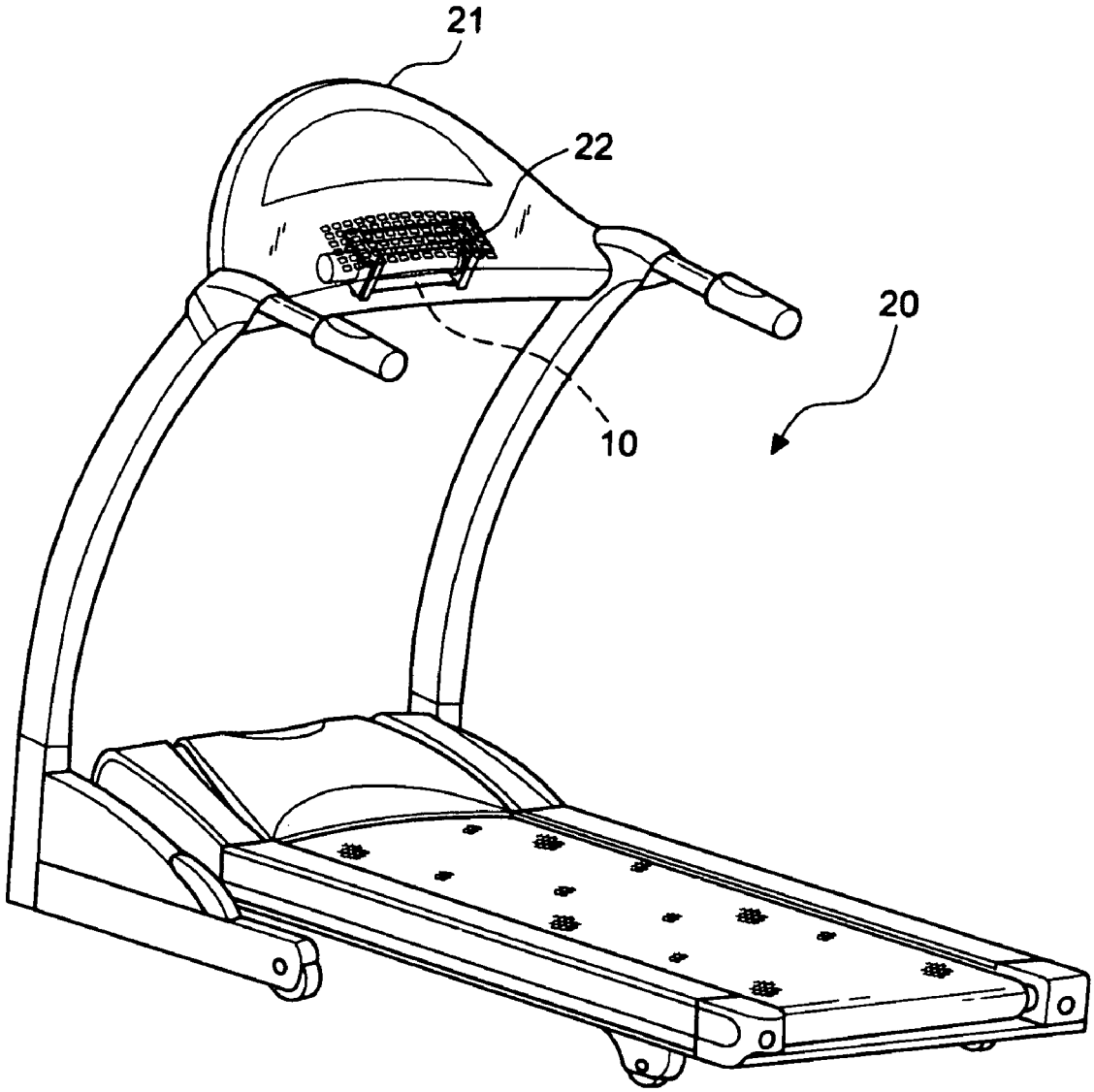
FIG.1 PRIOR ART
FIG. 1 is a schematic drawing of a conventional treadmill.
Figure 2:
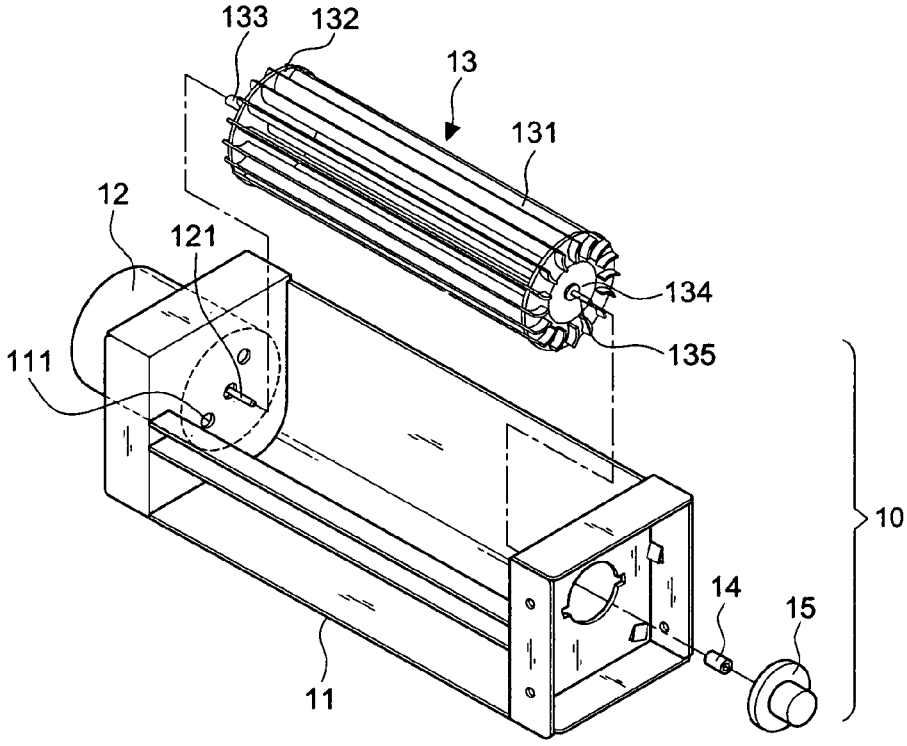
FIG.2 PRIOR ART
FIG. 2 is an exploded perspective view of a conventional cross-flow fan.
Figure 3:
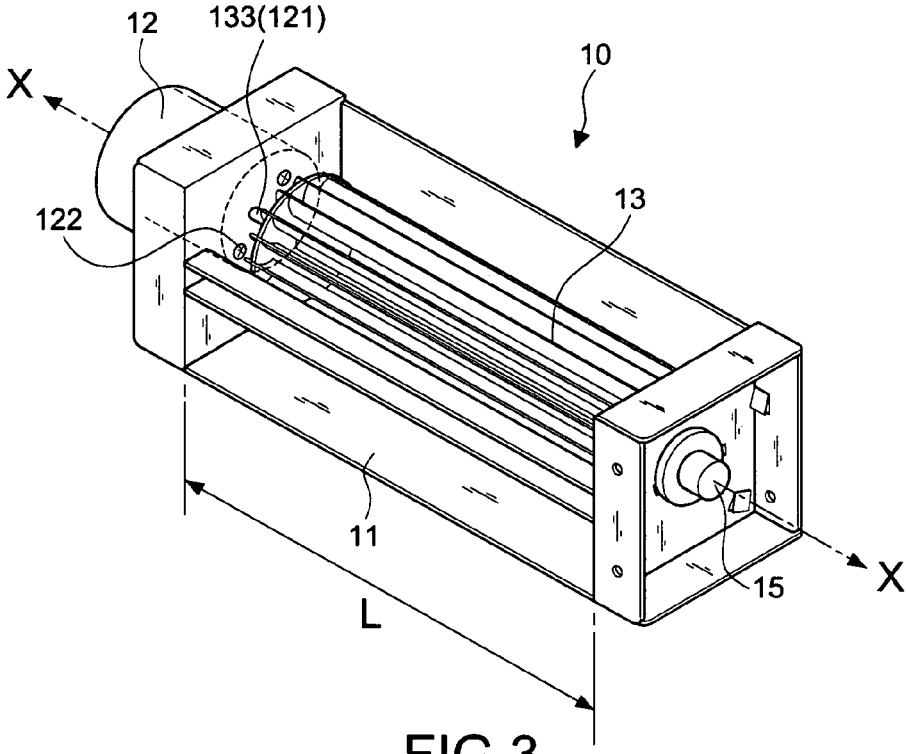
FIG.3 PRIOR ART
FIG. 3 is a perspective assembly view of the conventional cross-flow fan.
Figure 4:
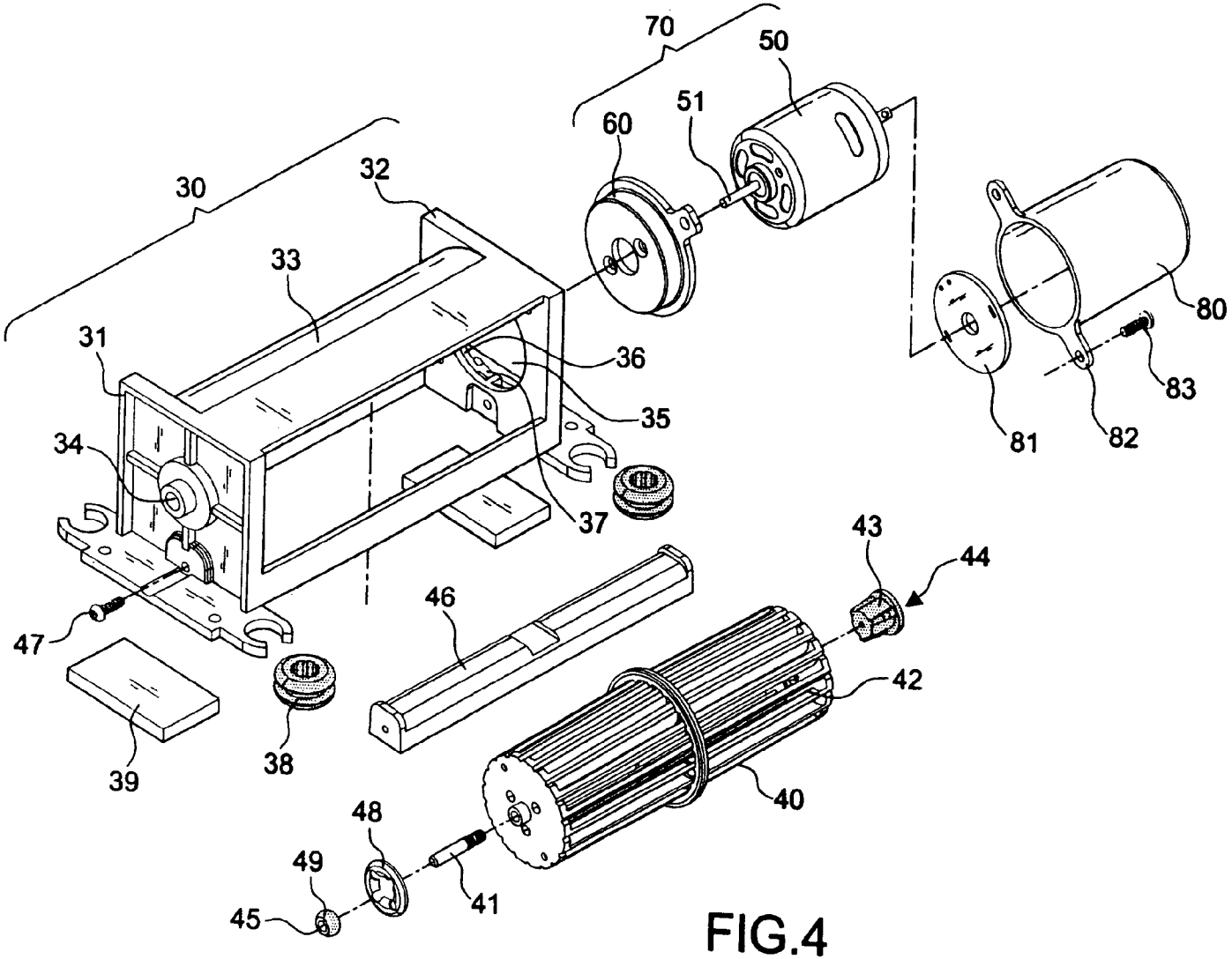
FIG. 4 is an exploded perspective view of the structure of the invention.

First of all, referring to FIGS. 4 through 9, a preferred embodiment of an arrangement for a quick positioning of a motor of a cross-flow fan in accordance with the invention includes a housing 30, a cross-flow fan 40, and a motor apparatus 70.

The housing 30 includes a left plate 31, a right plate 32 and an L-shaped wind deflector 33 between the left and right plates 31, 32. The left plate 31 has a first mounting hole 34 while the right plate 32 includes a second mounting hole 35 with a greater diameter. A convex ring 36 and several securing lugs 37 are arranged around the external rim of the second mounting hole 35.

The cross-flow fan 40 includes a shaft 41 at the left side thereof. A ball-shaped oily bearing 45 fits over the shaft 41 and is received within the first mounting hole 34. According to this embodiment, the ball-shaped oily bearing 45 is retained by a claw-shaped metal holder 48 within the first mounting hole 34. Oily wool felt 49 is positioned between the claw-shaped metal holder 48 and the ball-shaped oily bearing 45. In this way, a constant lubrication is ensured for a smooth operation of the cross-flow fan 40. A third mounting hole 42 is axially formed at the right side of the cross-flow fan 40 for accommodating a shock-absorbing body 43. Moreover, the shock-absorbing body 43 is provided with a shaft hole 44 in the axial direction.

The motor apparatus 70 includes a motor body 50 and a mounting base 60. The mounting base 60 is disposed at the side facing a driving shaft 51 of the motor body 50. The mounting base 60 has a mounting member 61 and a flange member 62. The mounting member 61 is matched to the convex ring 36 for a tight insertion into the second mounting hole 35. The flange member 62 is formed around the rim of the mounting member 61 and snugly secured to the convex ring 36. The external side of the flange member 62 is provided with projecting ears 63 corresponding to the securing lugs 37 of the convex ring 36. The projecting ears 63 are secured by screws 67 from outside such that the motor apparatus 70 may rapidly and precisely fit into the second mounting hole 35. Meanwhile, the driving shaft 51 is extended into the shaft-retaining hole 44 of the shock-absorbing body 43 of the cross-flow fan 40 for imparting the rotary motion to the cross-flow fan 40.

Figure 5:
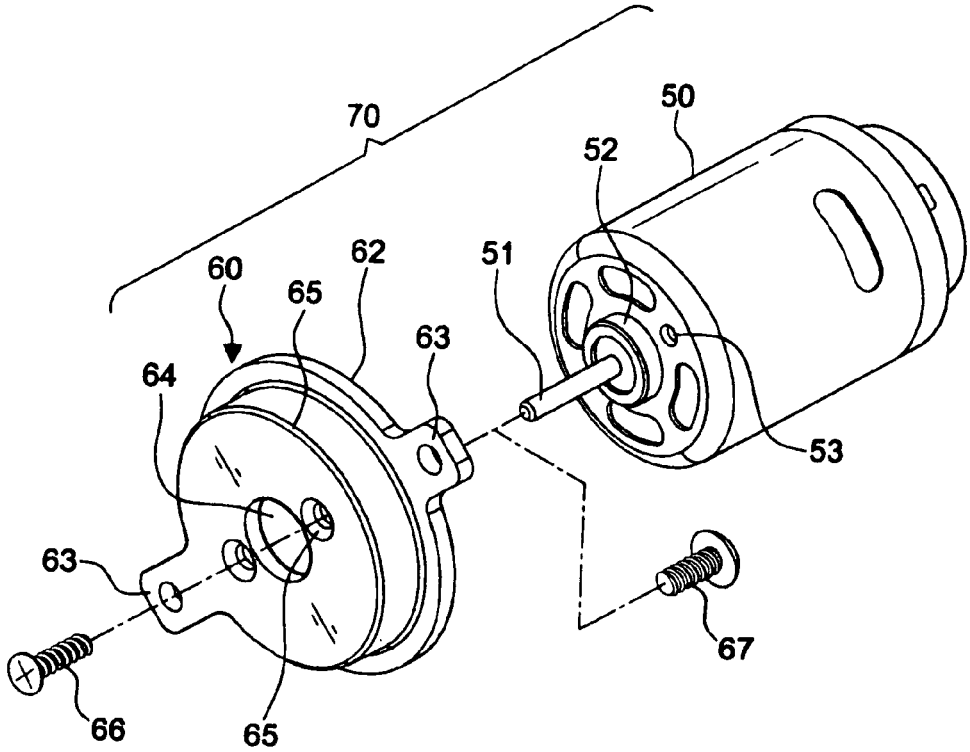
FIG. 5 is an exploded perspective view of a motor apparatus in accordance with the invention.
Figure 6:
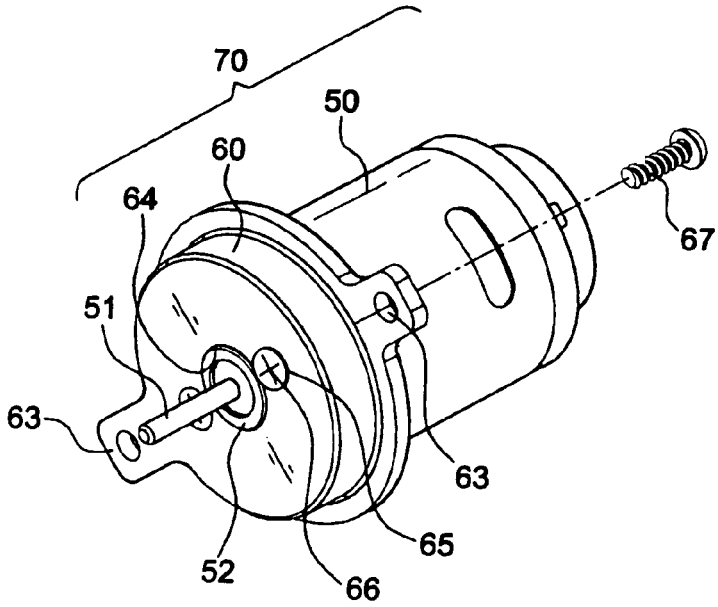
FIG. 6 is a perspective assembly view of the motor apparatus in accordance with the invention.

As shown in FIG. 6, the mounting base 60 of the motor apparatus 70 is integrally formed with the motor body 50. Alternatively, as shown in FIG. 5, the motor body 50 and the mounting base 60 of the motor apparatus 70 are separately formed and then combined together. A projecting shaft support 52 is fitted to the side of the motor body 50 to accept the driving shaft 51. Moreover, at least one fixing hole 53 is formed at the side of the shaft support 52. In addition, a mounting hole 64 facing to the shaft support 52 is formed at the center of the mounting member 61 of the mounting base 60. Besides, a plurality of positioning holes 65 are provided in match of the fixing holes 53. A screw 66 is employed to fit thereinto for combining the mounting base 60 and the motor body 50 in a body (see FIG. 6).

Figure 7:
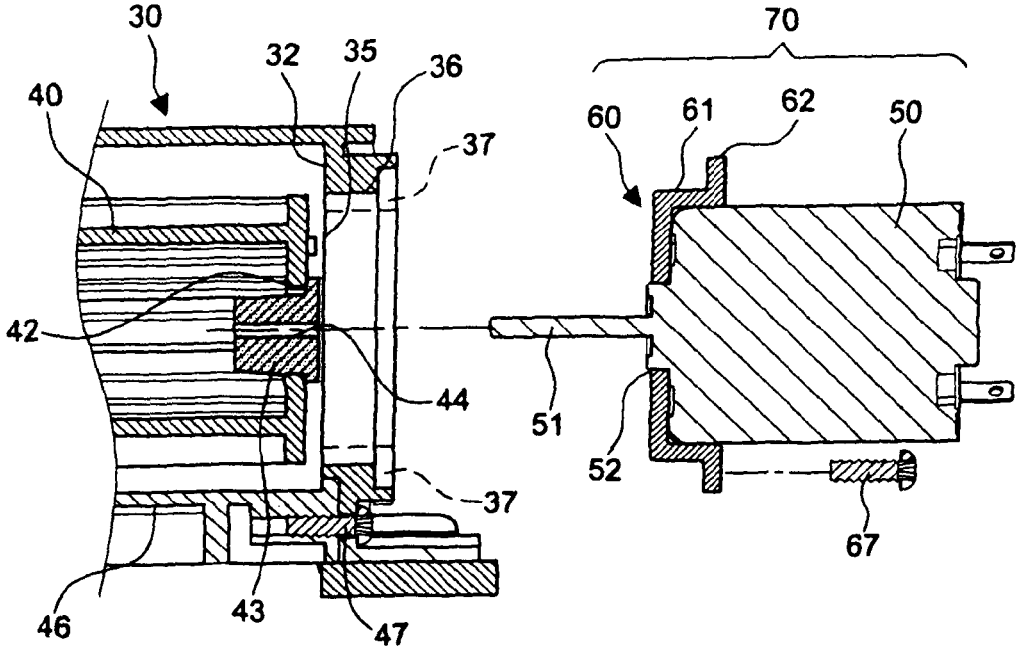
FIG. 7 is a cutaway view of the motor apparatus and the cross-flow fan in a separation position in accordance with the invention.
Figure 8:
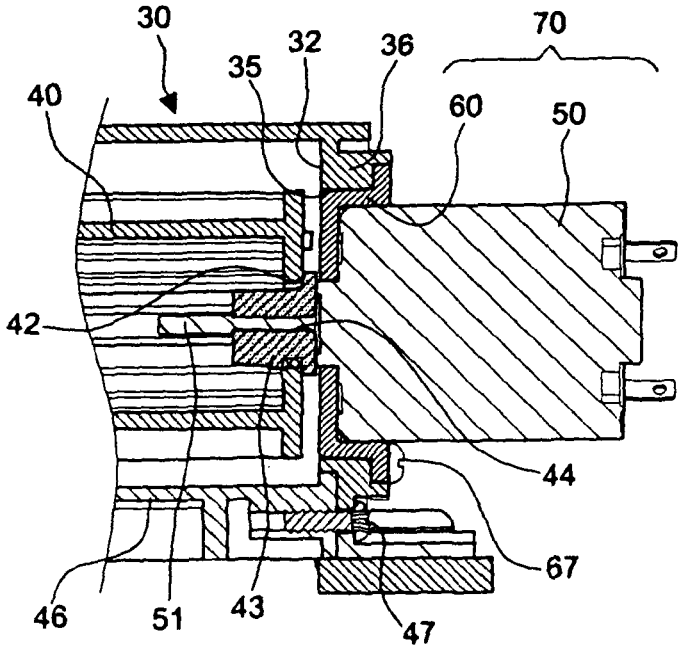
FIG. 8 is a cutaway view of the motor apparatus and the cross-flow fan in an assembly position in accordance with the invention.
Figure 9:
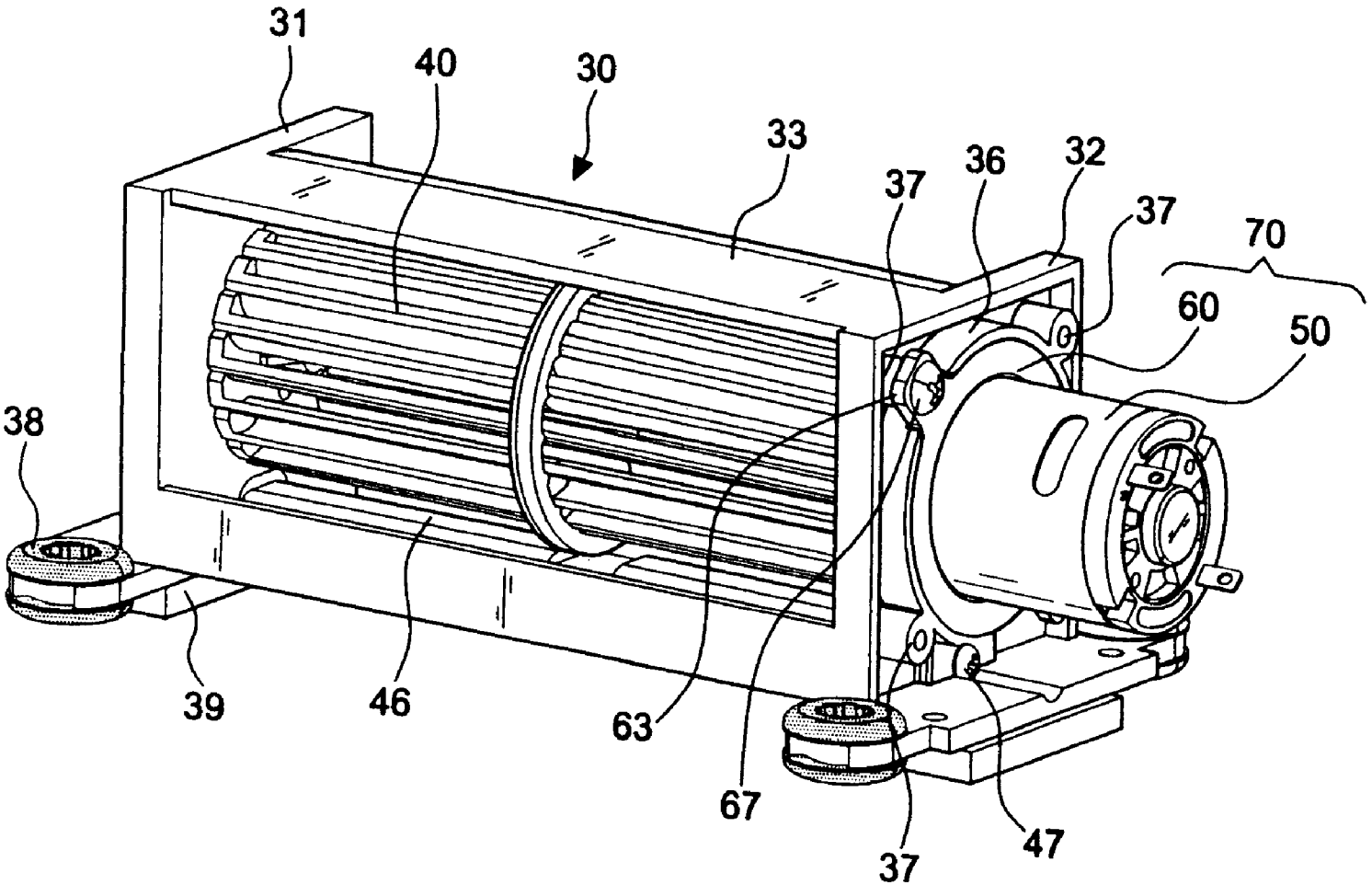
FIG. 9 is a perspective view of a preferred embodiment in accordance with the invention.

As shown in FIGS. 7 through 9, the motor apparatus 70 fits into the second mounting hole 35 with the mounting base 60. At the same time, the mounting member 61 is locked into the convex ring 36 in place. In this way, the motor body 50 can be secured from outside. Meanwhile, the driving shaft 51 is accurately positioned at the center of the second mounting hole 35 and aligned to the shaft-retaining hole 44 of the shock-absorbing body 43 of the cross-flow fan 40. The shock-absorbing body 43 is made of rubber and owns, therefore, elasticity such that the driving shaft 51 is held in place for imparting rotary motion to the cross-flow fan 40 when fitting into the shaft-retaining hole 44. The motor apparatus 70 can be secured from outside, and the center of the motor body 50 can be automatically corrected. As a result, the assembly is very easy. After the mounting process, a practical alignment to the center is achieved when the motor apparatus 70 is fastened by the screws 67 on the securing lugs 37. A manual correction is no more required.

Moreover, the driving shaft 51 fits into the shaft-retaining hole 44 of the shock-absorbing body 43 for imparting the rotary motion to the cross-flow fan 40. The shaft of the cross-flow fan 40 is supported by the shock-absorbing body 43 and the bearing 45 when the cross-flow fan 40 is laterally rotated and even if the length thereof is greater. The trembling action or the noise created by the rotary power will be lessened by use of the impact absorption of the rubber material of the shock-absorbing body 43 and the bearing 45.

Accordingly, the driving shaft 51 is automatically corrected and accurately aligned to the rotary axle by means that the motor apparatus 70 is held by the mounting base 60 in place first and bolted from outside. In this way, a misalignment can be avoided so that the undesirable vibration is minimized. Moreover, a smooth operation is achieved. The built-in electronic elements won't be damaged when it is installed within a control panel.

In addition, a strengthening bar 46, four rubber pads 38, and two cushioning strips 39 are fitted to the bottom of the housing 30 for enhancing the housing's strength and the shock-absorption effect.

Figure 10:
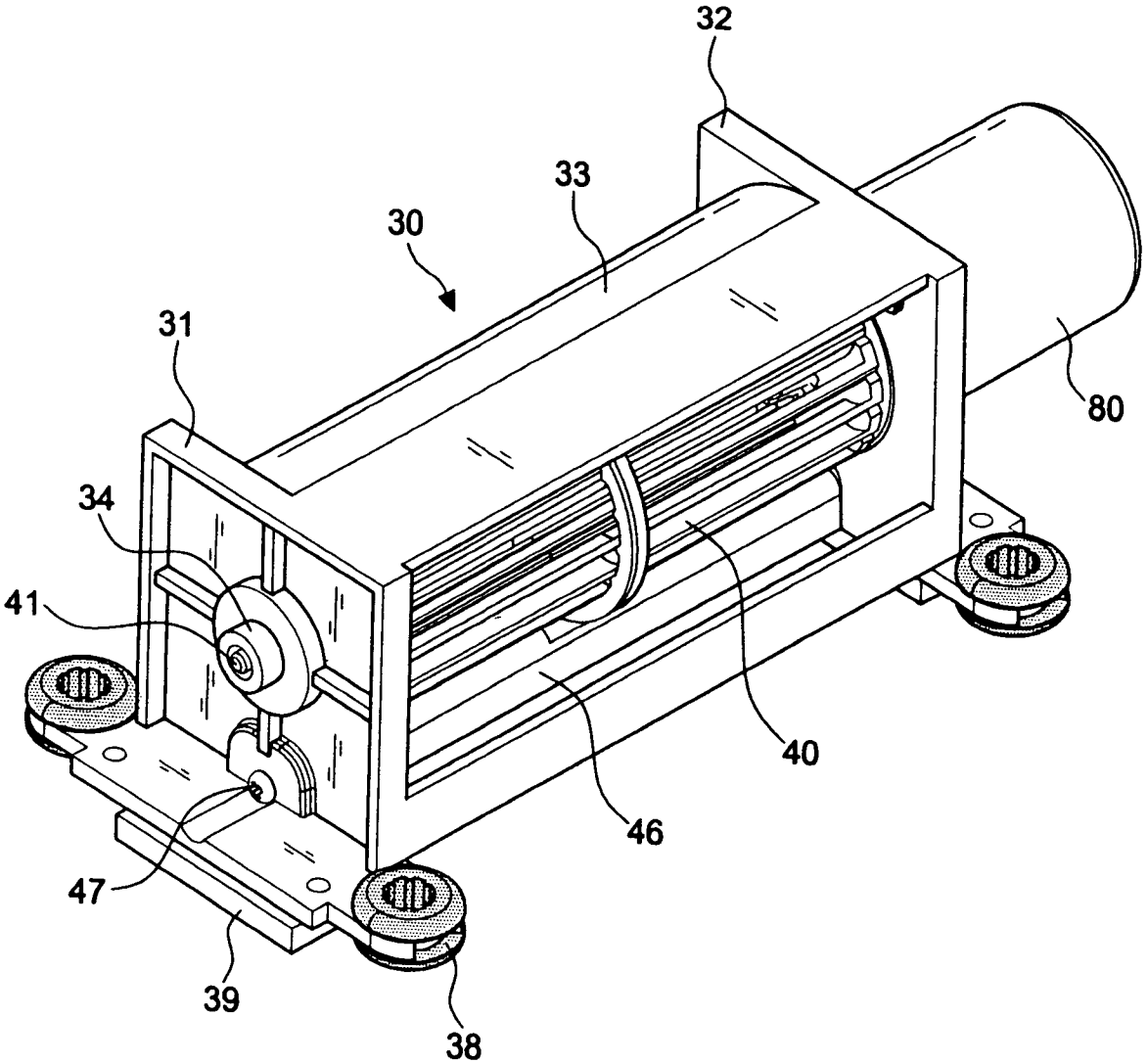
FIG. 10 is a perspective view of the motor fitted with a mounting tube in accordance with the invention.
Figure 11:
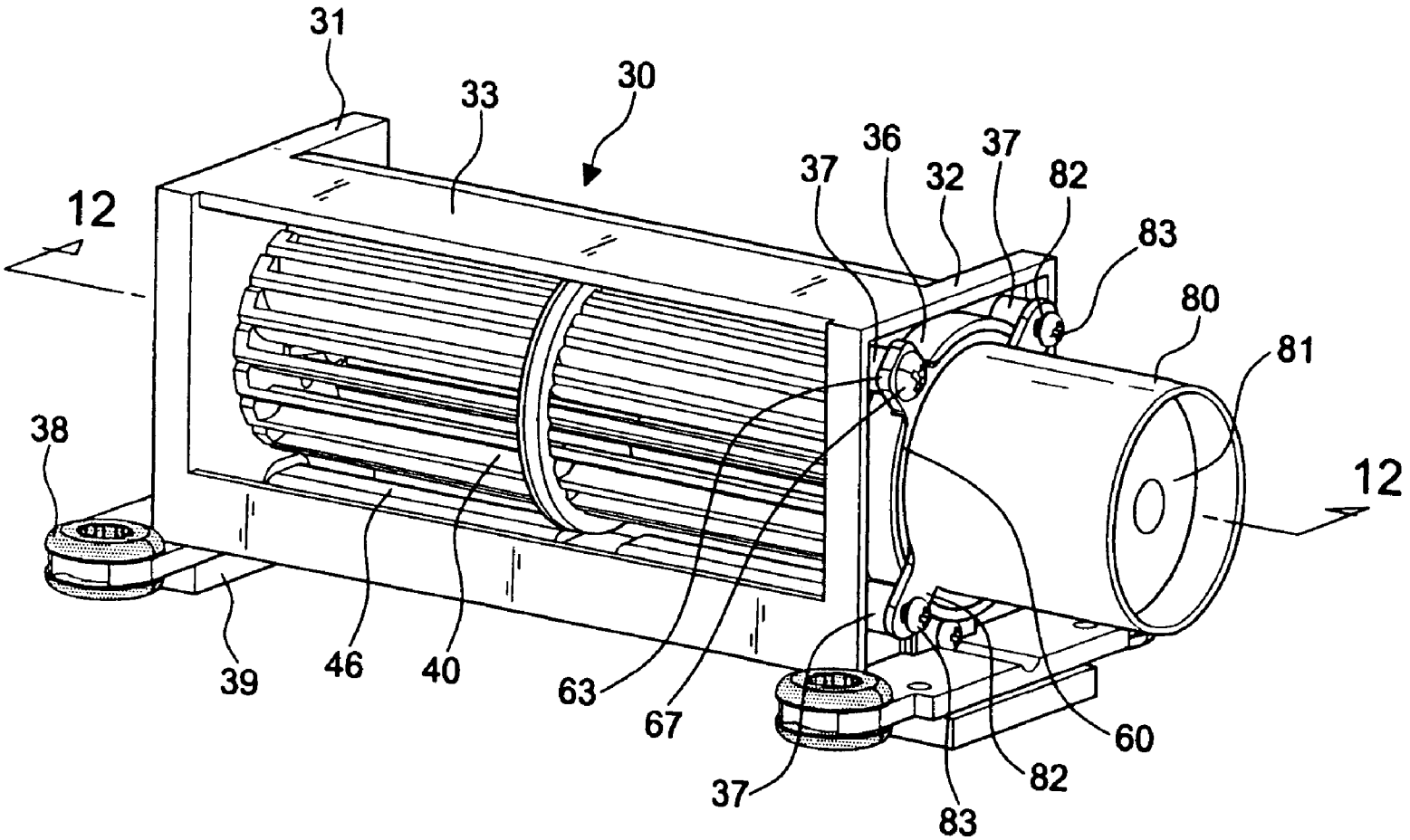
FIG. 11 is a perspective view of the motor fitted with a mounting tube in accordance with the invention seen from the other side.
Figure 12:
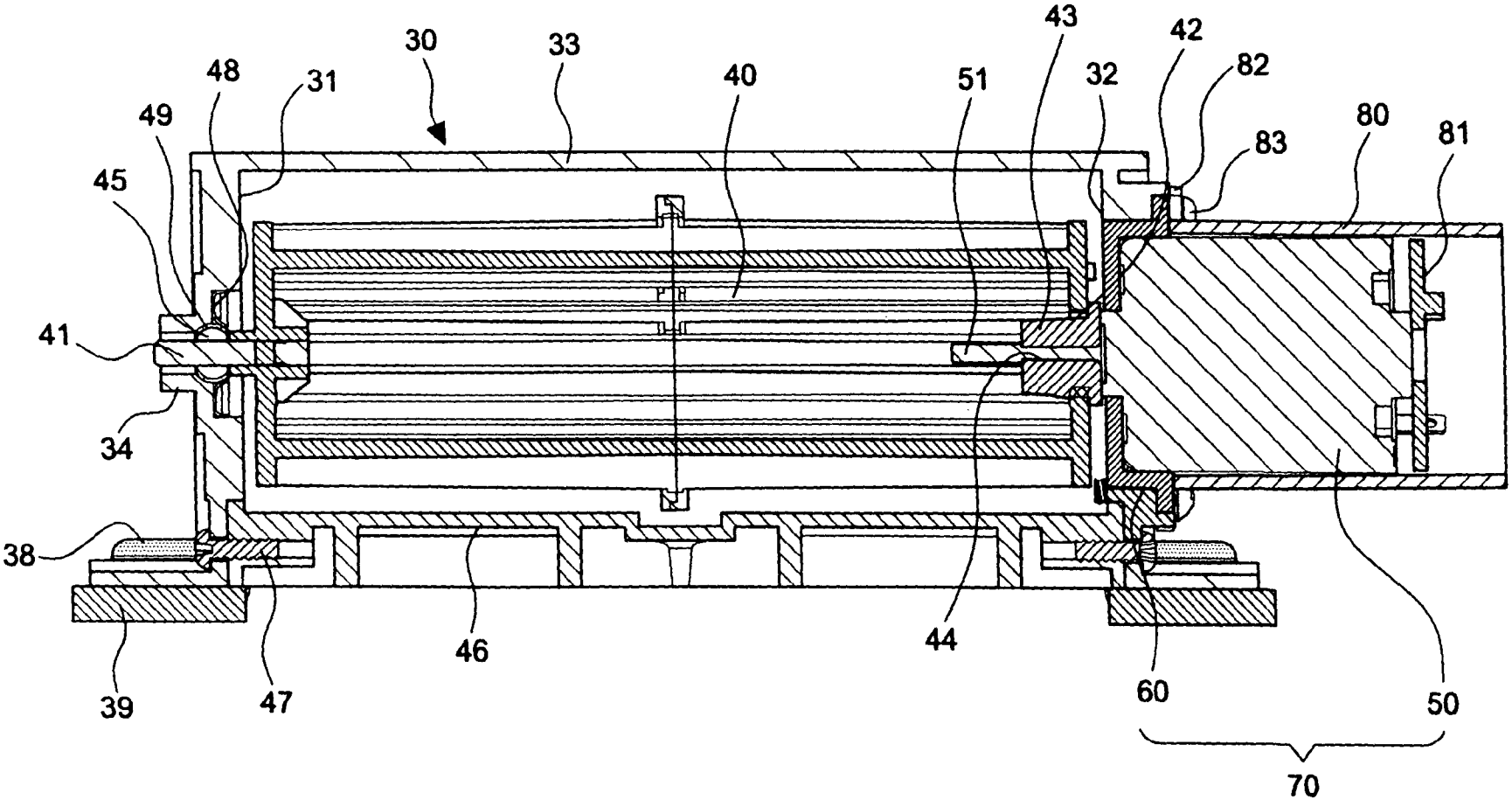
FIG. 12 is a cross-sectional view taken along the line 12-12 in FIG. 11.

Furthermore, as shown in FIGS. 10 through 12, the motor apparatus 70 is enclosed by a mounting tube 80 and a cover 81. The mounting tube 80 includes projecting ears 82 at the front end of the external side thereof such that it is fixed by screws 83 on the securing lugs 37 in the immediate proximity of the second mounting hole 35. The cover 81 is held within the mounting tube 80 in place and positioned at the tail of the motor body 50. In this way, the motor body 50 is protected from damages due to the external actions.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An arrangement for a quick positioning of a motor of a cross-flow fan, comprising:

a) a housing having a first plate, a second plate and an L-shaped wind deflector between the first and second plates, the first plate having a first mounting hole, the second plate having a second mounting hole with a greater diameter than the first mounting hole, a convex ring and several securing lugs being arranged around a rim of the second mounting hole on the second plate;

b) a cross-flow fan having a shaft at a first side thereof positioned within the first mounting hole, a third mounting hole being axially formed at a second side of the cross-flow fan for accommodating a shock-absorbing body, the shock-absorbing body being provided with a shaft-retaining hole in an axial direction; and c) a motor apparatus having a motor body and a mounting base, the mounting base being disposed at a side of the motor apparatus facing a driving shaft of the motor body, the mounting base having a mounting member and a flange member, the mounting member being matched to the convex ring for a tight insertion into the second mounting hole, the flange member being formed around a rim of the mounting member and snugly secured to the convex ring, an external side of the flange member being provided with projecting ears corresponding to the securing lugs of the convex ring, the projecting ears being secured to the securing lugs by screws such that the motor apparatus may rapidly and precisely fit into the second mounting hole, the driving shaft being extended into the shaft-retaining hole of the shock-absorbing body of the cross-flow fan for imparting rotary motion to the cross-flow fan;

wherein a projecting shaft support is fitted to a side of the motor body to accept the driving shaft; and wherein a fourth mounting hole is formed at the center of the mounting member of the mounting base, the fourth mounting hole coaxially receiving the projecting shaft support therein.

2. The arrangement for a quick positioning of a motor of a cross-flow fan as recited in claim 1, wherein the motor body and the mounting base of the motor apparatus are separately formed and then combined together, wherein at least one fixing hole is formed on the motor body at a side of the projecting shaft support, wherein at least one positioning hole is provided in the mounting member to match the at least one fixing hole, and wherein at least one screw is employed to combine the mounting base and the motor body via the at least one positioning hole and the at least one fixing hole.

3. The arrangement for a quick positioning of a motor of a cross-flow fan as recited in claim 1, wherein the motor body is enclosed by a mounting tube and a cover, wherein the mounting tube includes projecting ears at a front end thereof such that it is also fixed by screws on the securing lugs in the immediate proximity of the second mounting hole, and wherein the cover is held within the mounting tube and positioned at a tail end of the motor body.

4. The arrangement for a quick positioning of a motor of a cross-flow fan as recited in claim 1, wherein the shock-absorbing body is made of rubber.

5. The arrangement for a quick positioning of a motor of a cross-flow fan as recited in claim 1, wherein a strengthening bar, rubber pads, and cushioning strips are fitted to a bottom of the housing.

6. The arrangement for a quick positioning of a motor of a cross-flow fan as recited in claim 1, wherein a ball-shaped oily bearing fits over the shaft at the first side of said cross-flow fan and is received within the first mounting hole, wherein the ball-shaped oily bearing is retained by a claw-shaped metal holder within the first mounting hole, and wherein oily wool felt is positioned between the claw-shaped metal holder and the ball-shaped oily bearing.

* * * * *